US008204413B2

(12) United States Patent
Brown

(10) Patent No.: US 8,204,413 B2
(45) Date of Patent: Jun. 19, 2012

(54) PRINTING JOB WITH DEVELOPER REMOVAL

(75) Inventor: Kenneth J. Brown, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 175 days.

(21) Appl. No.: 12/827,178

(22) Filed: Jun. 30, 2010

(65) Prior Publication Data

US 2012/0003015 A1 Jan. 5, 2012

(51) Int. Cl.
*G03G 15/09* (2006.01)
*G03G 15/08* (2006.01)

(52) U.S. Cl. ..... 399/273; 399/283

(58) Field of Classification Search ..... 399/273, 399/274, 283, 284
See application file for complete search history.

(56) References Cited

U.S. PATENT DOCUMENTS 3,927,640 A 12/1975 Smith et al.
3,981,272 A 9/1976 Smith
4,699,495 A 10/1987 Hilbert
5,550,619 A 8/1996 Komakine et al.
5,655,198 A * 8/1997 Ziegelmuller et al. ..... 399/283
6,108,499 A 8/2000 Cernusak
6,385,415 B1 * 5/2002 Hilbert et al. ..... 399/104
6,608,641 B1 8/2003 Alexandrovich et al.
7,120,379 B2 10/2006 Eck
7,343,108 B2 3/2008 Lairmore et al.
7,426,361 B2 9/2008 Thompson et al.
7,442,484 B2 10/2008 Uchinokura et al.
7,502,581 B2 3/2009 Jacobs et al.
7,885,584 B2 * 2/2011 Stern et al. ..... 399/273
2002/0168200 A1 11/2002 Stelter et al.
2006/0133870 A1 6/2006 Ng
2006/0280529 A1 12/2006 Nakagawa et al.

* cited by examiner

*Primary Examiner* — Hoang Ngo
(74) *Attorney, Agent, or Firm* — Christopher J. White

(57) ABSTRACT

A printer includes a development member for providing toner to a photoreceptor. A developer remover is located between a developer supply and the photoreceptor in the direction of rotation of the development member, and selectively contacts the development member to remove developer therefrom. A controller receives a print job, determines a non-developing zone of the development member corresponding to the non-image area of the job, and determines a developing zone of the development member corresponding to the image area of the job. The developer remover removes developer when it is in the non-developing zone, but not when it is in the developing zone.

4 Claims, 11 Drawing Sheets

PRINTING JOB WITH DEVELOPER REMOVAL

CROSS-REFERENCE TO RELATED APPLICATIONS

Reference is made to commonly assigned, co-pending U.S. patent application Ser. No. 12/827,168, filed concurrently herewith, entitled "REDUCING BACKGROUND DEVELOPMENT IN ELECTRO-PHOTOGRAPHIC PRINTER," by Kenneth J. Brown, the disclosure of which is incorporated by reference herein.

FIELD OF THE INVENTION

This invention pertains to the field of electrophotographic printing and more particularly to removing developer from a development member.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

However, toner is sometimes transferred to locations on the receiver where it is not desired. This results in print images with more noise or lower contrast than desired. This phenomenon is referred to as "background development." It is desirable to reduce background development to provide high image quality.

It is known to remove developer from a development member used to develop the latent image into the visible image. U.S. Pat. No. 3,927,640 to Smith describes a magnetic gate for stopping developer flow when it is desired to purge the development system. U.S. Pat. No. 3,981,272 to Smith et al. describes a development system with a movable sump for storing developer. Neither of these schemes has any effect on background development.

U.S. Pat. No. 7,442,484 to Uchinokura et al. points out that removing toner particles from the surface of the photoreceptor can be difficult, and those particles can result in undesired background development. The scheme described in this patent uses chemically-prepared toner and an induction fuser, and is therefore not useful for many electrophotographic printers using alternatives to those components.

U.S. Pat. No. 6,108,499 to Cernusak describes cleaning waste toner off a photoconductor drum using a cleaning blade. However, Cernusak points out background development can result from electrical and mechanical wear on the photoconductor. Cleaning the waste toner produces mechanical wear.

U.S. Pat. No. 5,550,619 to Komakine et al. describes a removal roller for removing excess toner from a latent image holding member to reduce background development.

There is an ongoing need, therefore, for an improved way of reducing background development that is applicable to a wide range of electrophotographic printers.

SUMMARY OF THE INVENTION

According to the present invention, there is provided a printer for printing a job onto a receiver, the job including boundary data defining an image area of a separation and a non-image area of the separation, and image data defining a visible image to be produced in the image area, the printer comprising:

a) a rotatable photoreceptor for transferring the visible image comprising toner and corresponding to the image data onto the image area of the moving receiver;

b) a rotatable development member arranged with respect to the photoreceptor to provide toner to the photoreceptor;

c) a developer supply arranged with respect to the development member to provide developer to the development member, wherein the developer includes toner;

d) a developer remover disposed adjacent to the rotatable development member between the developer supply and the photoreceptor in the direction of rotation of the development member, the developer remover operative to selectively make physical contact with at least one point on the development member to remove developer from the development member; and e) a controller responsive to the boundary data and adapted to perform the following functions while printing the job onto the receiver:

i) calculate a non-developing zone of the development member corresponding to the non-image area, and a developing zone of the development member corresponding to the image area; and ii) cause the developer remover to contact the development member when the developer remover is in the non-developing zone, and for causing the developer remover to not contact the development member when the developer remover is in the developing zone.

An advantage of this invention is that it is applicable to a wide variety of electrophotographic machines. It is simple to implement. In various embodiments, developer for color components not used for a particular image is not sent through the toning zone or mixed, reducing wear and scumming of developer, and extending the life of carrier particles in a two-component developer. In various embodiments, the present invention advantageously stops the flow of developer without requiring additional clutches or motors. Various embodiments of the present invention operate without requiring lossy clutches in the primary drive path of the development member, thus improving power efficiency. Various embodiments use small, lightweight moving parts. The present invention can reduce developer loss ("DPU") in non-image areas.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
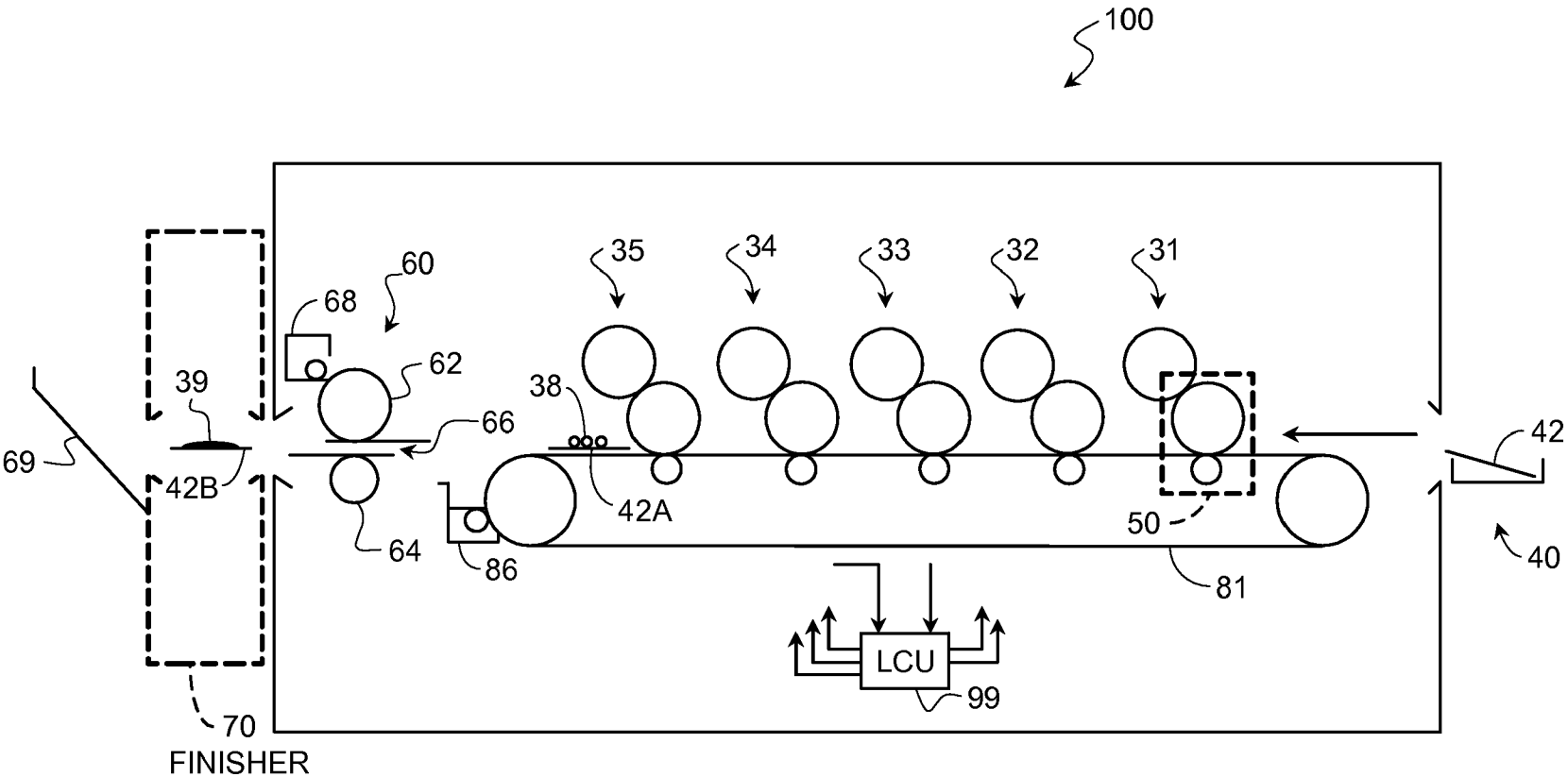
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, photoreceptor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture of toner and magnetic carrier particles, which can be electrically-conductive or -non-conductive. Toner particles can be magnetic or non-magnetic. The carrier particles can be larger than the toner particles, e.g. 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
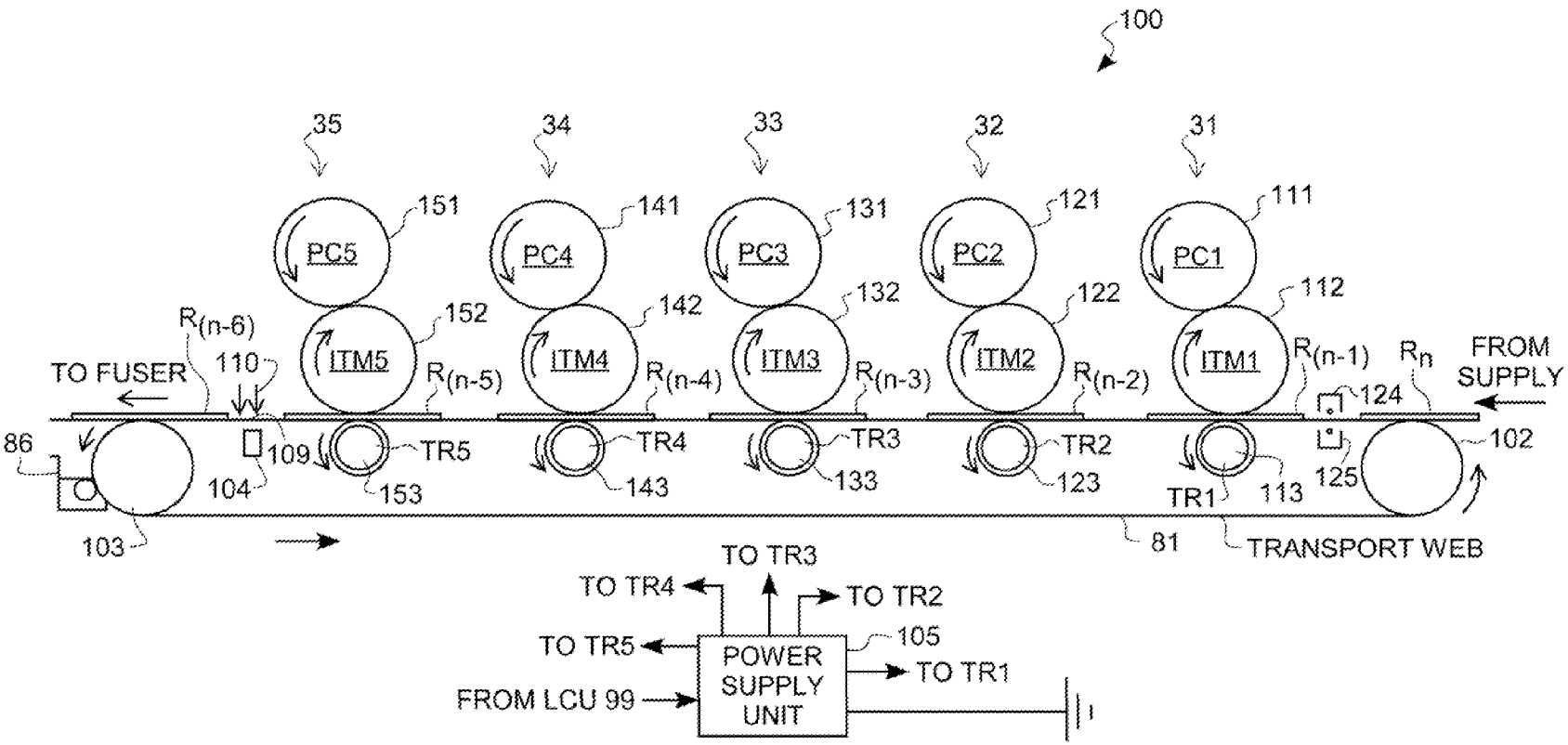
FIG. 2 is an elevational cross-section of the reprographic image-producing portion of the apparatus of FIG. 1.
Figure 3:
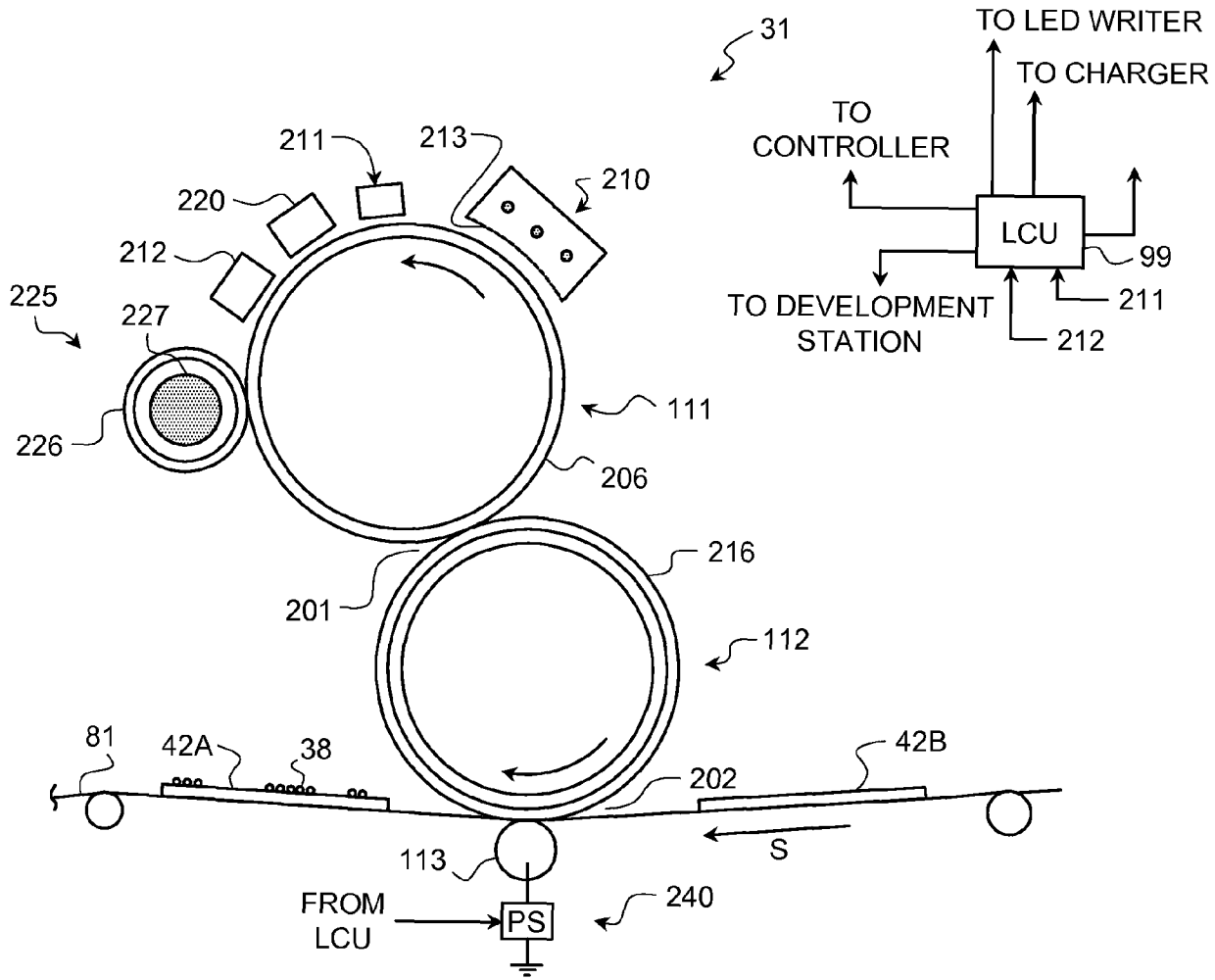
FIG. 3 is an elevational cross-section of one printing module of the apparatus of FIG. 1.

FIGS. 1-3 are elevational cross-sections showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counter-clockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g. a roller or belt, an intermediate transfer member (112, 122, 132, 142, 152), e.g. a blanket roller, and transfer backup member (113, 123, 133, 143, 153), e.g. a roller, belt or rod. Thus in printing module 31, a print image (e.g. a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Densitometer 104 is preferably located between printing module 35 and roller 103. Reflection densitometers, and more or fewer test patches, can also be used.

FIG. 3 shows more details of printing module 31, which is representative of printing modules 32, 33, 34, and 35. Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g. laser or LED writers), and the respective development station 225 of each printing module 31, 32, 33, 34, 35, among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoreceptor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g. of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, the term "engine pixel" means the smallest addressable unit on photoreceptor 206 or receiver 42 which the light source (e.g. laser or LED) can expose with a selected exposure different from the exposure of another engine pixel. Engine pixels can overlap, e.g. to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, to apply toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g. a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages. Development station 225, or toning shell 226, can be development members.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S.

Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g. 42B) which receives the respective toned print images 38 from each printing module in superposition to form a composite image thereon. Print image 38 is e.g. a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Figure 4:
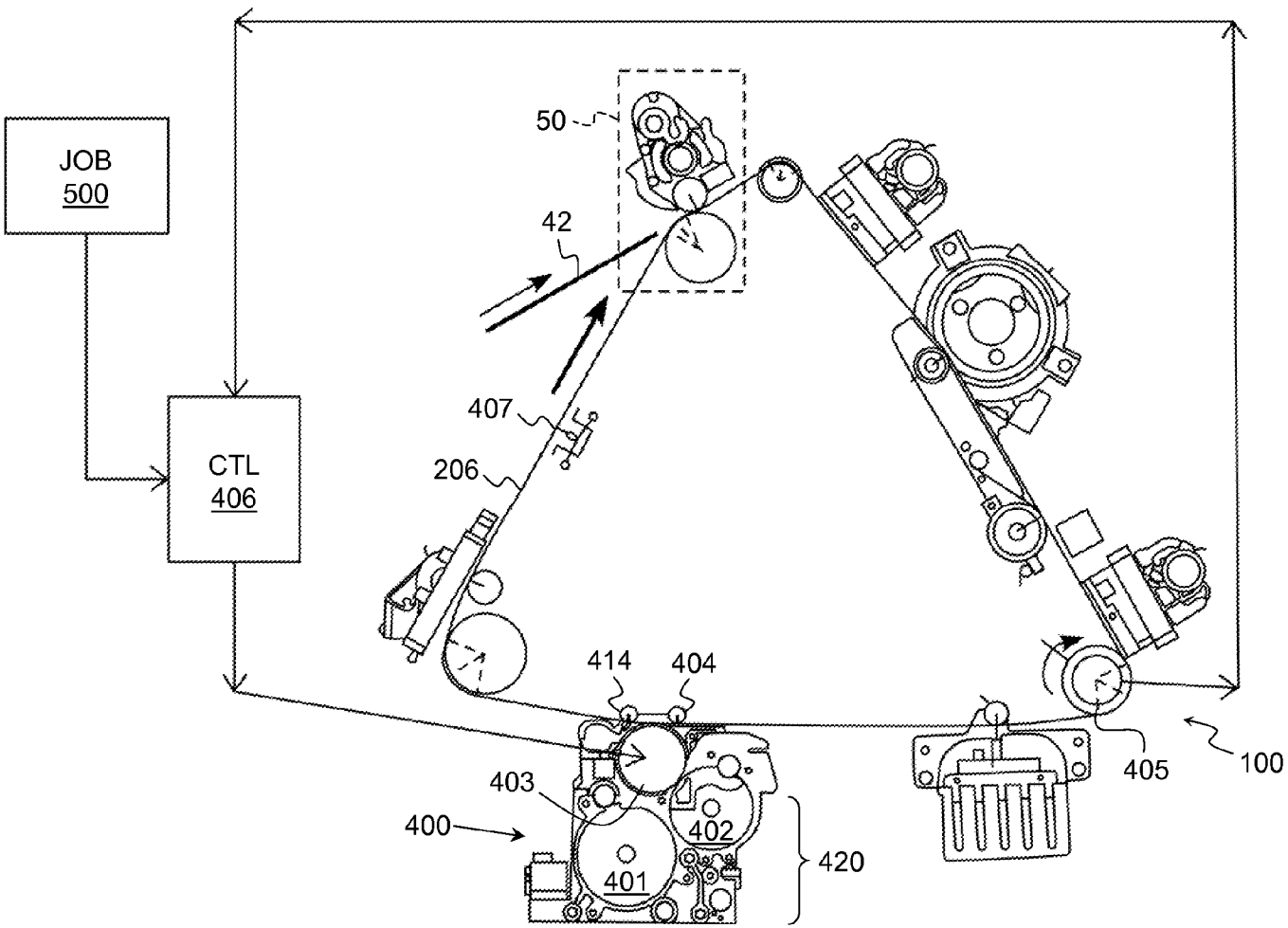
FIG. 4 is an elevational cross-section of another electrophotographic reproduction apparatus suitable for use with this invention.

FIG. 4 shows another embodiment of an electrophotographic printer 100 useful with the present invention. Image loop 407 includes rotatable web (belt) photoreceptor 206 (FIG. 3). Image loop 407 is another embodiment of an imaging member 111 (FIG. 3). As used herein, the "width" of the photoreceptor is measured into the page on this view, i.e. across the image-bearing surface of the photoreceptor. For a cylindrical (drum) photoreceptor such as that shown in FIG. 3, the "width" is measured down the axis of the cylinder. Transfer subsystem 50 transfers the visible image on photoreceptor 206 to receiver 42. Encoder 405 measures the distance travelled by loop 407 and provides that information to controller 406. Encoder 405 can be an optical, Hall-effect, or other encoder type known in the art. Controller 406 can be a CPU, FPGA, PLD, PAL, or other logic device implementing the functions described below. Controller 406 is also responsive to job 500, as will be discussed further below with reference to FIG. 5.

In an embodiment, photoreceptor 206 and image loop 407 can handle 6-A4 or 8.5" sheets plus the gaps or interframes between the sheets in one cycle of the image loop starting and ending at the splice. This is referred to as "6-frame mode." That is, a "frame" is the area of image loop 407 that can print one A4 or 8.5"×11" sheet. Photoreceptor 206 is present in each frame, but can be interrupted between frames. Image loop 407 includes 6 timing marks (f-perfs), one to start each image frame. Other modes, including 3-, 4-, and 5-frame, can be produced using encoder counts to interpolate between f-perfs. The printer can thus print 3, 4, 5 or 6 images or sheets of paper for each revolution of image loop 407 depending on the paper size in the in-track direction (around the loop). Not every frame is required to be occupied with a receiver in any given cycle. A process control frame as described below is preferably one frame of the smallest frame size, which is obtained in the 6-frame mode. Additional details of frames are found in U.S. Pat. No. 7,343,108 to Lairmore et al., the disclosure of which is incorporated herein by reference.

Photoreceptor 206 transfers a visible image comprising toner, as described above, onto a moving receiver 42. Development station 400, which is controlled by controller 406, includes rotatable development member 403 arranged with respect to photoreceptor 206 to provide developer (and toner) to photoreceptor 206, so that the latent image on photoreceptor 206 is developed into a visible image. Backup bars 404, 414 hold image loop 407, and thus photoreceptor 206, in position with respect to development member 403 to receive the toner. Developer supply 420 is arranged with respect to development member 403 to apply a blanket of developer to development member 403. In various embodiments, developer supply 420 includes blender 401 for mixing toner and carrier particles to maintain uniform toner loading of the developer, and bucket roller 402. Bucket roller 402 includes a plurality of radial paddles adapted to push developer coming off blender 401 towards development member 403. In various embodiments, developer supply 420 can include a sump, feed roller, or feed auger. Bucket roller 402 can include a helix or not. Additional details of development station 400 can be found in U.S. Pat. No. 7,426,361(B2) to Thompson et al., the disclosure of which is incorporated herein by reference.

Figure 5:
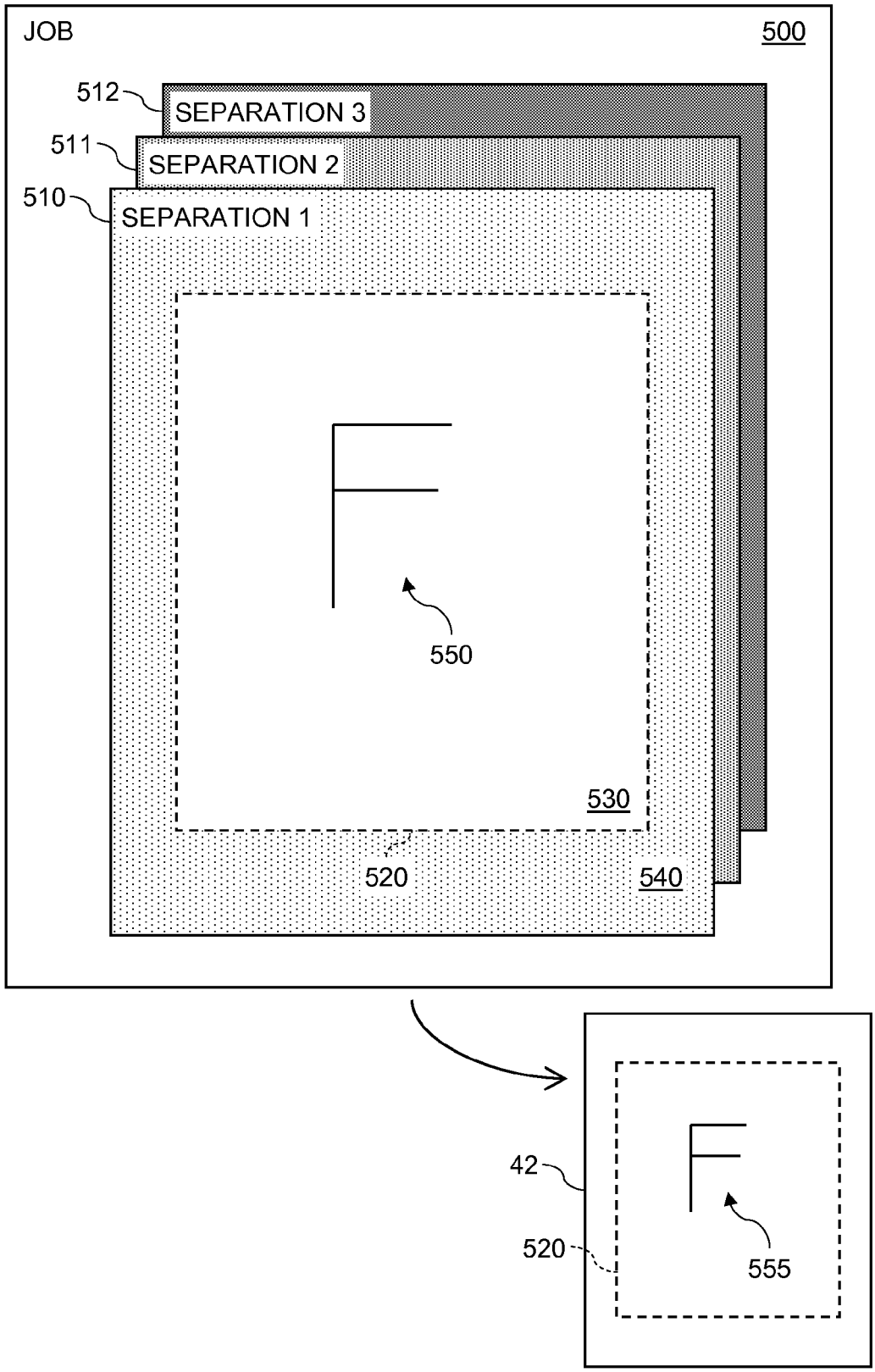
FIG. 5 is a data structure diagram showing a print job.

FIG. 5 is a data structure diagram showing a print job according to an embodiment of the invention. Job 500, shown here, is a single-page job; multi-page jobs are handled by processing each page individually. Job 500 includes one or more separation(s), e.g. separations 510, 511, 512. When separation 510 is discussed herein, the same remarks apply to any other separations. Each separation (e.g. 510) includes respective boundary data 520 defining a respective image area 530 and a respective non-image area 540. Each separation (e.g. 510) also includes respective image data 550. Image data 550 defines a respective visible image 555 to be produced in the respective image area 530 of each separation (e.g. 510) when the separations are printed on receiver 42. In various embodiments, the width and height of separation 510 are the same as, or different than, the width and height of receiver 42, respectively. For 1-up printing, separation 510 typically has the same dimensions as receiver 42, or slightly larger, to provide space for edge-trimming to produce a full-bleed print. For n-up printing with n>1, separation 510 is typically smaller than receiver 42, e.g.≦50% of the size of receiver 42 for 2-up printing.

Referring to FIG. 5 and also back to FIG. 4, photoreceptor 206 in printer 100 transfers a visible image corresponding to image data 550 onto the image area 530 of the moving receiver 42. Controller 406 is responsive to job 500, and specifically to boundary data 520.

Figure 6A:
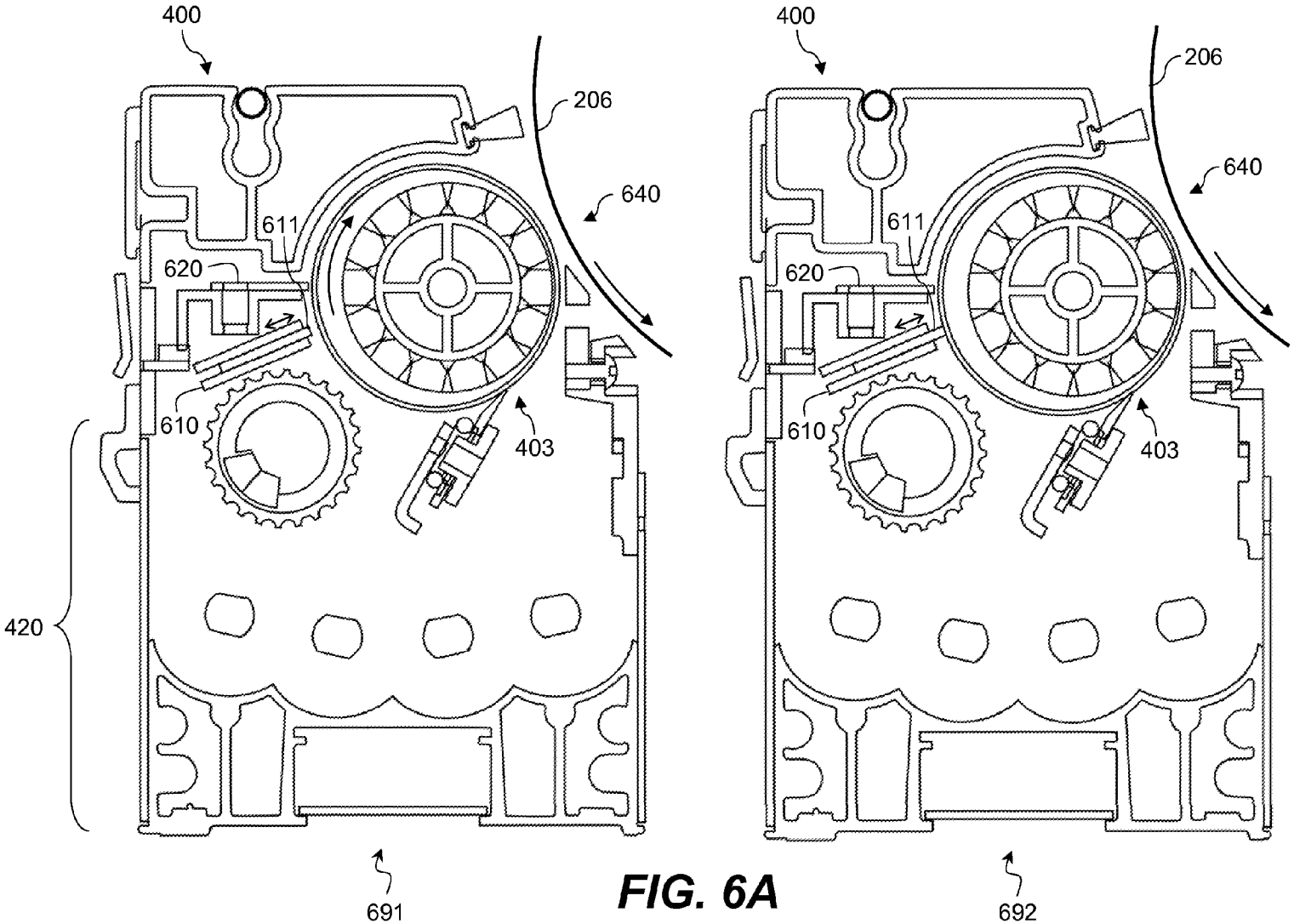
FIGS. 6A and 6B are detailed views of a development station according to various embodiments.

FIG. 6A is a detailed view of a development station 400 in printer 100 (FIG. 1) according to an embodiment of the invention. Rotatable photoreceptor 206, rotatable development member 403, and developer supply 420 are as discussed above with reference to FIGS. 2-4. Development member 403 supplies toner to photoreceptor 206 in toning zone 640. Development station 400 is as discussed above, and also includes developer remover 610 for removing developer from development member 403. Developer remover 610 can selectively remove some or all of the developer on a selected portion of, or all of, the surface of development member 403. Two positions (states) of developer remover 610 are shown: position 691 and position 692.

Developer remover 610 is disposed adjacent to development member 403 between developer supply 420 and photoreceptor 206 in the direction of rotation of the development member. Developer remover 610 is operative to selectively make physical contact with at least one point on development member 403 to remove developer from development member 403. In an embodiment, developer remover 610 is a rubber or plastic squeegee that presses against development member 403 and scrapes developer off development member 403 along the full width of developer remover 610. In another embodiment, developer remover 610 is a skiving blade. Developer remover 610 can make contact with development member 403 at one or more point(s), along one or more line(s), in one or more area(s), or any combination of those. In the embodiment of FIG. 6A, developer remover 610 includes retractable blade 611. In position 691, blade 611 is retracted to permit developer to pass to toning zone 640. In position 692, blade 611 is extended to strip developer from development member 403.

Figure 6B:
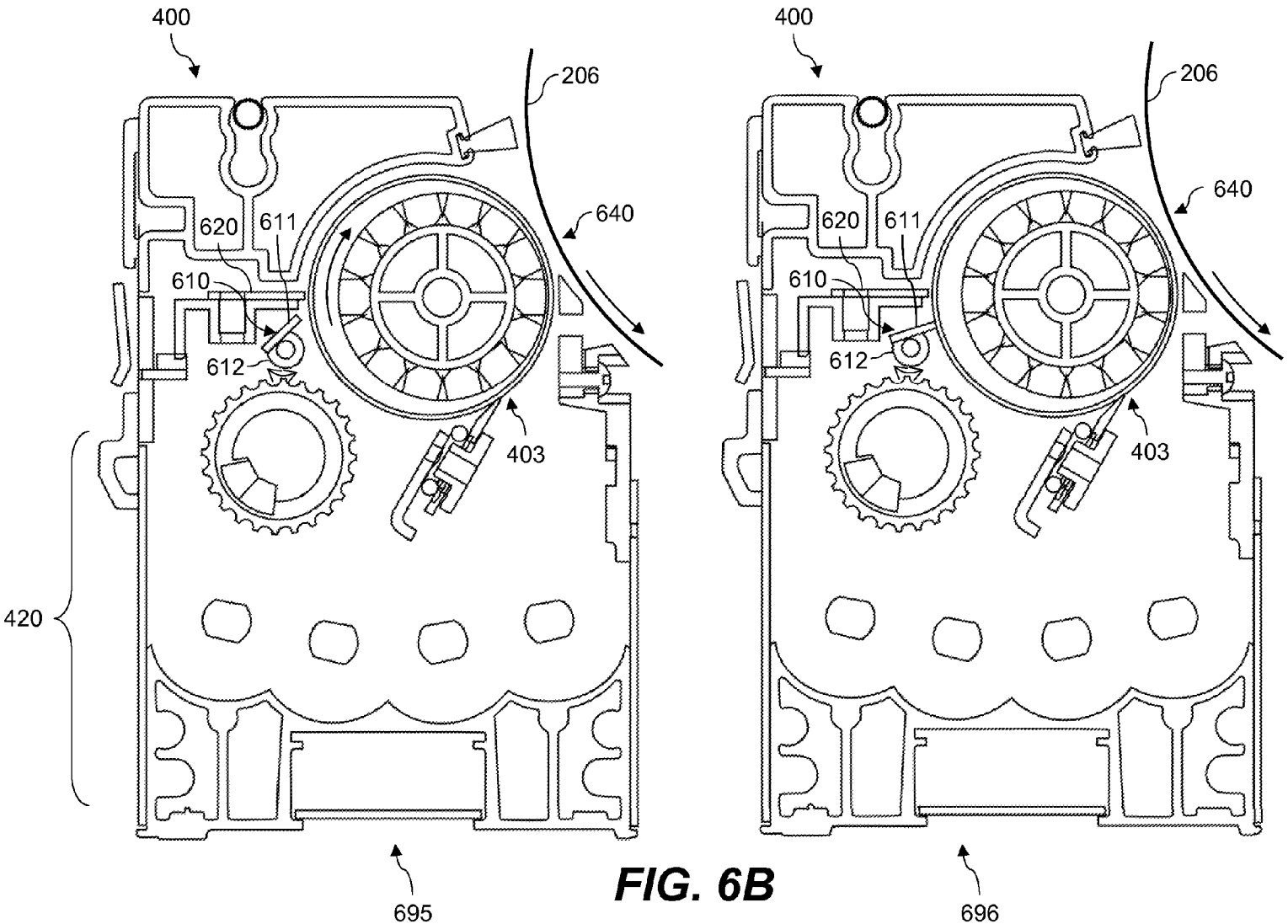

FIG. 6B shows another embodiment of developer remover 610 in two positions (states): position 965 and position 696. Rotatable photoreceptor 206, rotatable development member 403, developer supply 420, development member 403, toning zone 640, development station 400 are as discussed above with reference to FIG. 6A. Developer remover 610 includes hub 612 on which is mounted blade 611. In position 695, hub 612 rotates counter-clockwise so blade 611 is pulled away from development member 403. This permits developer to pass to toning zone 640. In position 696, hub 612 rotates clockwise to bring blade 611 into contact with development member 403, so that developer is stripped from development member 403.

In various embodiments, e.g. those shown in FIGS. 6A-6B, development station 400 also includes metering skive 620 disposed adjacent to development member 403 between developer remover 610 and photoreceptor 206 in the direction of rotation of development member 403, for permitting at most a selected amount of developer to pass metering skive 620.

In various embodiments, developer supply 420 includes a mixer (not shown) selectively operable to mix the developer. A mixer can be a blender, as described above with respect to FIG. 4 (e.g. blender 401) or other mixing device known in the art.

Figure 7:
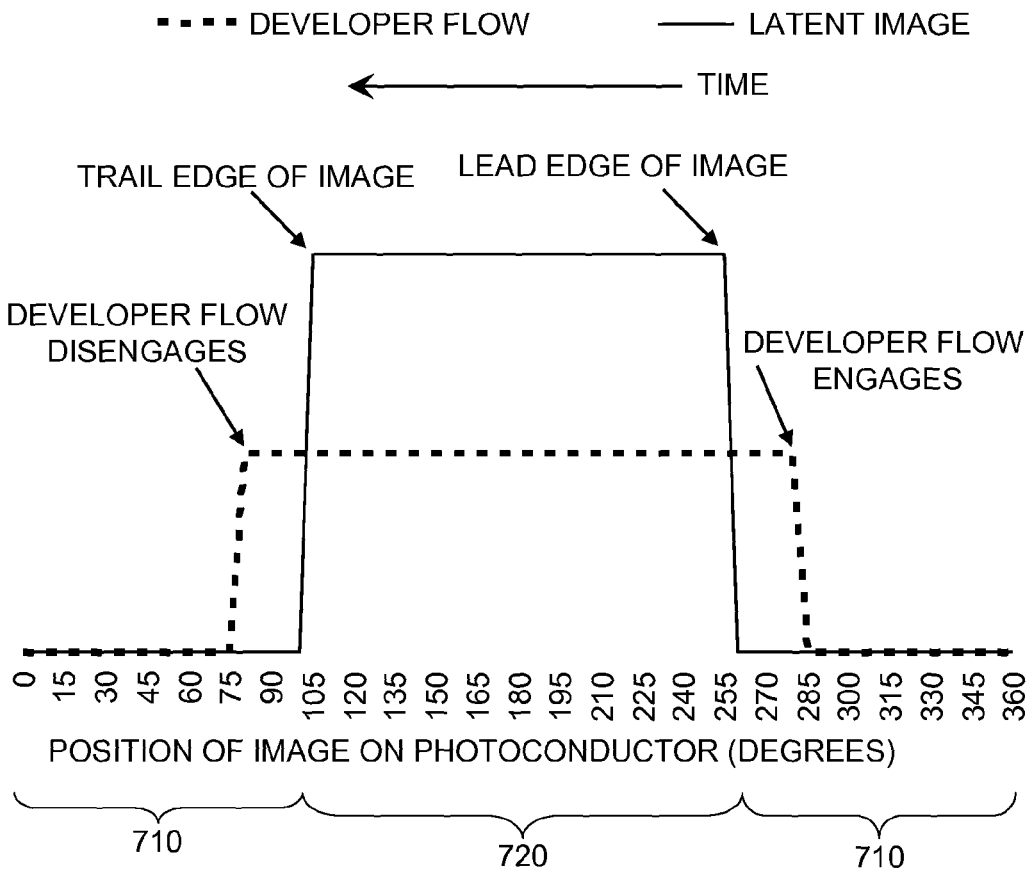
FIG. 7 is a graph of developer flow into development zone as a function of position of the photoreceptor in the toning zone according to an embodiment.

FIG. 7 is a graph of developer flow into development zone as a function of position of the photoreceptor in toning zone 640 according to an embodiment. The abscissa is labeled with the radial position in degrees on photoreceptor 206 that is at the center of toning zone 640. Each position on receiver 42 corresponds to a specific portion of photoreceptor 206 which is in toning zone 640. The ordinate shows latent image strength and developer flow in arbitrary units (developer flow is conventionally measured in g/in/s). Developer flow engages. Photoreceptor 206 can rotate once, more than once, or less than once per receiver 42, so position on receiver 42 is not shown and not relevant to this analysis. In this example, degrees on the photoreceptor 206 are measured counter-clockwise, and the photoreceptor 206 is rotating counter-clockwise, so time moves from right to left on the graph and degrees decrease.

As shown, developer flow into toning zone 640 is zero for most of non-developing zone 710. Non-developing zone 710 is that portion of the development member 403 corresponding to non-image area 540 of separation 510. That is, when a portion of photoreceptor 206 in toning zone 640 corresponds to a position on receiver 42 in non-image area 540, the portion of development member 403 positioned to provide toner to that portion of photoreceptor 206 is in non-developing zone 710. Since development member 403 can rotate at the same or different rate or direction than photoreceptor 206, non-developing zone 710 of development member 403 can extend around development member 403 once, less than once, or more than once. In an embodiment, development member 403 rotates so that its tangential velocity at the normal to development member 403 through the point of closest proximity between photoreceptor 206 and development member 403 is the same as the tangential velocity of photoreceptor 206 at the same normal.

Developer flow ramps up before developing zone 720 is reached. Developing zone 720 of development member 403 corresponds to image area 530 of separation 510 and receiver 42 in the same way that non-developing zone 710 corresponds to non-image area 540. Developer flow does not ramp down until after developing zone 720 is exited. This provides sufficient developer flow over the entire extent of developing zone 720. Developer flow starts and stops beyond developing zone 720 to take into account the radial distance between the developer remover and toning zone on the photoreceptor. In this example, the lead/lag is 30°. Non-developing zone 710 and developing zone 720 can include multiple separated regions, and can extend any whole or fractional number of times>0 around development member 403.

Referring also back to FIG. 6, controller 406 causes developer remover 610 to contact development member 403 when developer remover 610 is in non-developing zone 710. That is, when non-developing zone 710 includes a normal to development member 403 that passes through a point of physical contact between developer remover 610 and development member 403, controller 406 causes developer remover 610 to make physical contact at that point. Controller 406 also causes developer remover 610 to not contact development member 403 when developer remover 610 is in the developing zone. That is, when all normals to development member 403 taken through respective points of contact with developer remover 610 are included in developing zone 720, the developer remover is retracted and developer is permitted to pass.

Figure 8:
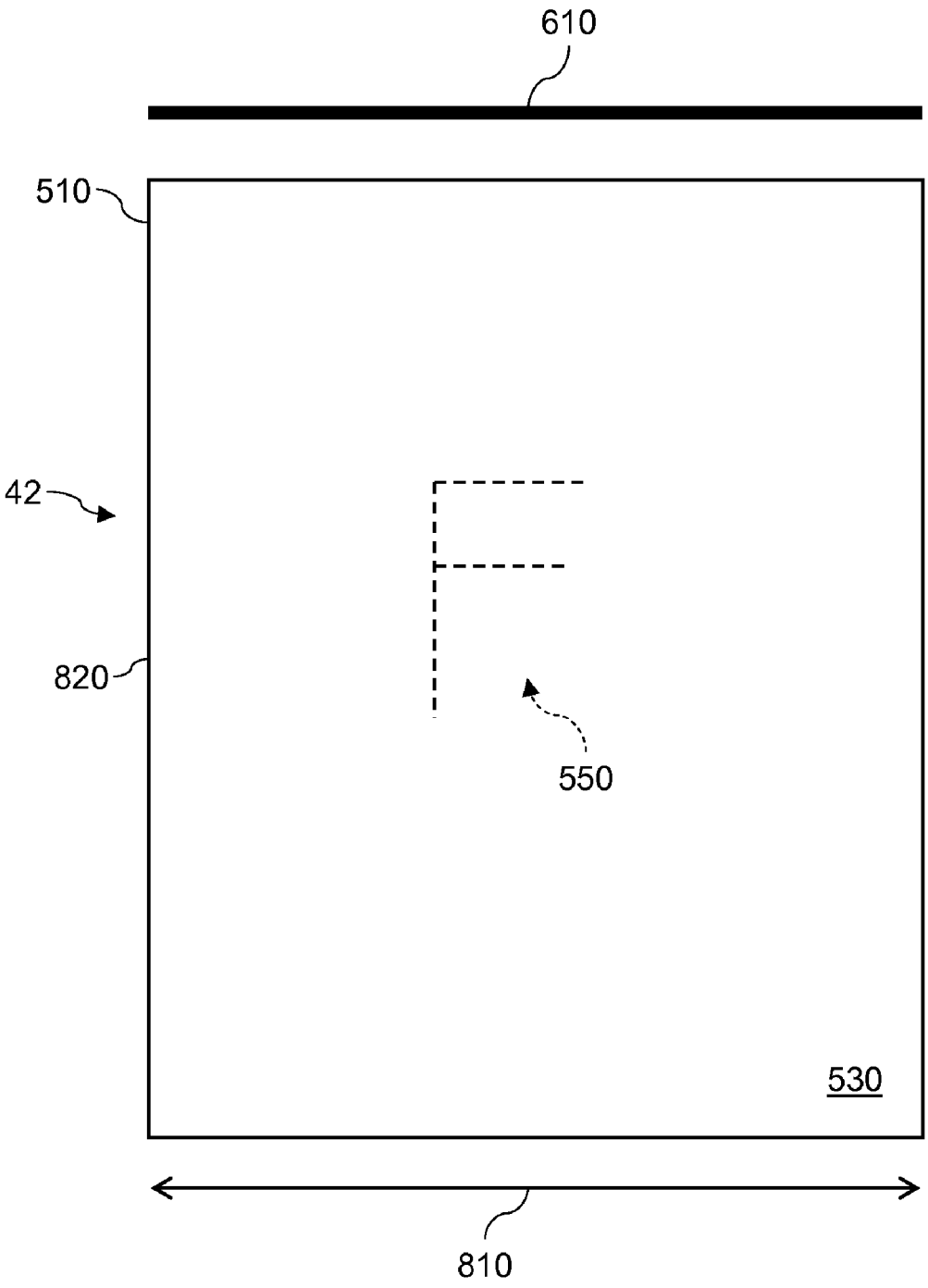
FIG. 8 shows a configuration of a printed page according to an embodiment.

FIG. 8 shows a configuration of a printed receiver 42 according to an embodiment. Image data 550 of separation 510 have been printed on the receiver in image area 530, which is a page window 820. A "page window" as used herein is an area the full size of the printable area on a single receiver. For example, for a 9" wide receiver that is printed, and off each edge of which is subsequently trimmed 0.25", the page window is 8.5" wide. Developer remover 610, represented graphically here as a thick line, extends across the full width 810 of image area 530. In this way developer can selectively be removed from development member 403 across the entire width of the image area 530 (page window 820).

Figure 9:
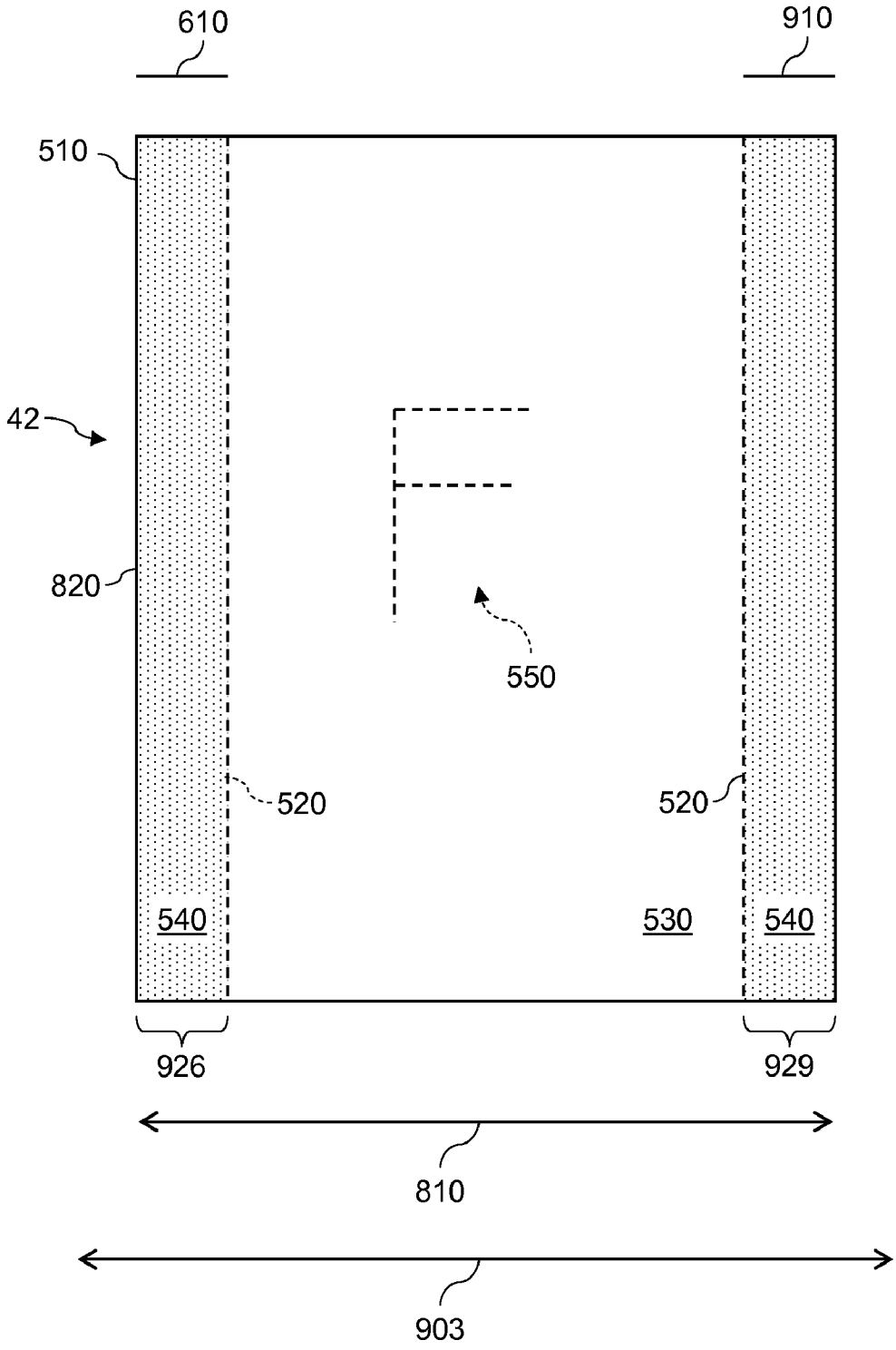
FIG. 9 shows another configuration of a printed page according to an embodiment.

FIG. 9 shows another configuration of a printed page according to an embodiment. Receiver 42 includes image area 530 and non-image areas 540 designated by boundary data 520. Image area 530 includes image data 550, as discussed above with respect to FIG. 5. Page window 820 is still the full printable width 810 of receiver 42, but image area 530 is smaller. Developer remover 610 is as described above.

Developer remover 910 is also operative to selectively make physical contact with at least one point on development member 403 to remove developer from development member 403. Developer remover 610 and second developer remover 910 extend across respective spans 926, 929 of the width 810 of development member 403 less than the width 810 of development member 403, so that the respective spans 926, 929 do not overlap or touch along the width of the development member. This provides two or more separate stripping areas on receiver 42. Controller 406 causes developer remover 910 to contact development member 403 when developer remover 910 is in non-developing zone 710 (FIG. 7), and causes developer remover 910 to not contact the development member when developer remover 910 is in developing zone 720 (FIG. 7).

In an embodiment, non-developing zone 710 includes a first span 926 across width 810 (for a drum photoreceptor 206, down the long axis) of development member 403, and a separate second span 929 across width 810. This permits stripping along the edges, or other places in which full-width printing is not desired.

In an embodiment development member 403 has width 903 greater in magnitude than width 810 of receiver 42 and page window 820.

Figure 10:
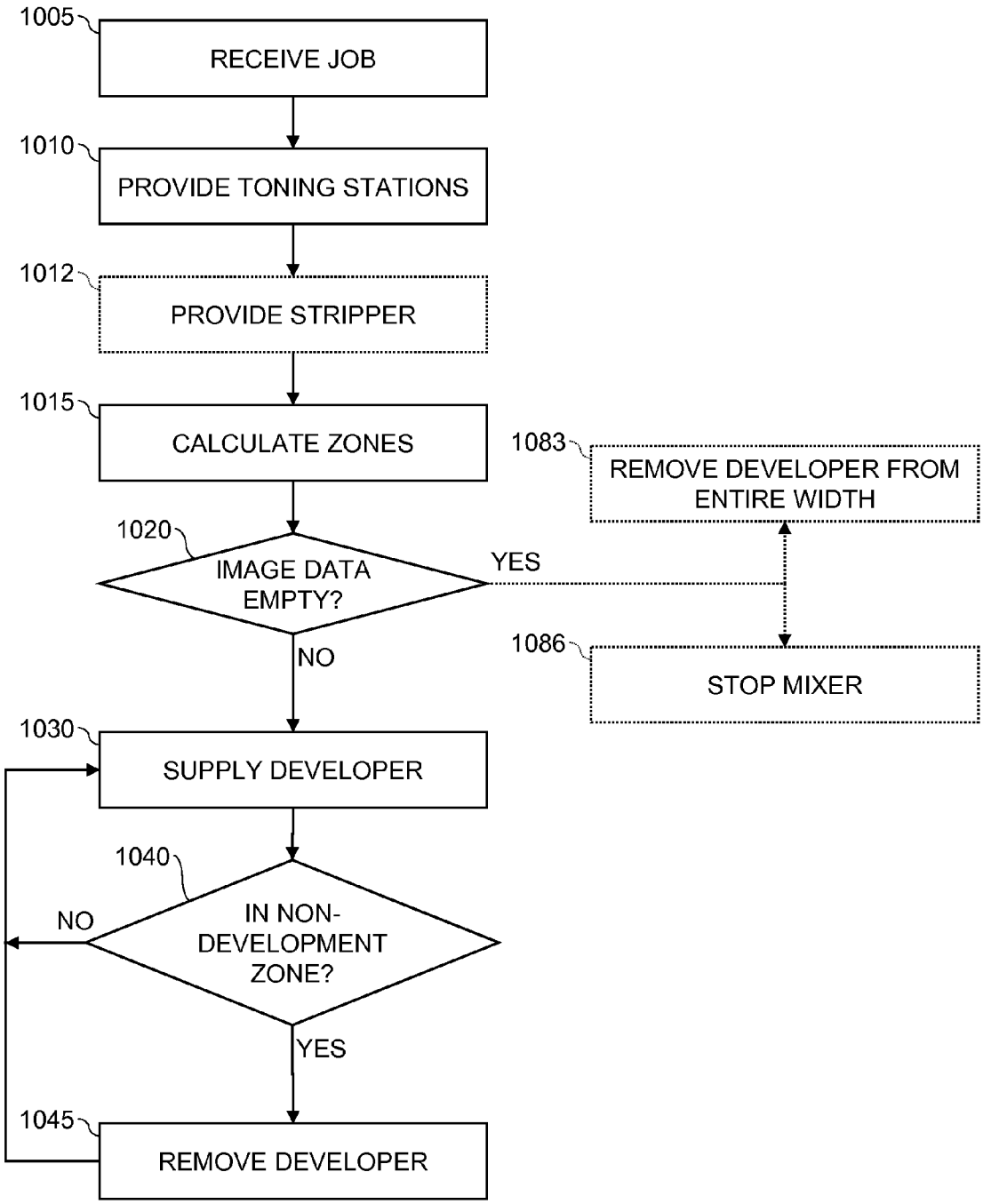
FIG. 10 is a flow chart of a method useful with the present invention.

FIG. 10 is a flow chart of a method useful with the present invention. Processing begins with step 1005.

In step 1005, a job to be printed onto a receiver is received. As discussed above with reference to FIG. 5, the job includes a plurality of separations, respective boundary data defining a respective image area of each separation and a respective non-image area of each separation, and respective image data defining a respective visible image to be produced in the respective image area of each separation. Step 1005 is followed by step 1010.

In step 1010, the development stations are provided. A respective development station is provided for each separation, each development station including a rotatable photoreceptor for transferring the visible image onto the image area of the moving receiver, wherein the visible image comprises toner and corresponds to the image data of the respective separation; and a rotatable development member arranged with respect to the photoreceptor to provide toner to the photoreceptor. These are as discussed above with reference to FIGS. 3 and 4. Step 1010 is followed by step 1015, optionally with step 1012 in between.

In optional step 1012, a developer remover is provided, as described above with reference to FIG. 6. Specifically, a developer remover is provided in each development station disposed adjacent to the respective rotatable development member before the respective photoreceptor in the direction of rotation of the development member and operable to selectively make physical contact with the development member to remove developer from the development member. Step 1012 is followed by step 1015.

In step 1015, developing and non-developing zones are calculated, as described above with reference to FIG. 7. Specifically, a respective non-developing zone of each development member is calculated corresponding to the respective non-image area of each separation. A respective developing zone of the respective development member is calculated corresponding to the respective image area of each separation. Step 1015 is followed by decision step 1020.

Decision step 1020 automatically determines whether the image data is empty. If it is, the next step is step 1083, step 1086, or both. If the image data is not empty, the next step is step 1030. By "the image data is empty" it is meant that image data 550 (FIG. 5) do not specify any substantial amount of toner to be applied to receiver 42 in image area 530, so visible image 555 is substantially empty of toner (excepting unwanted background development or other artifacts). This is discussed further below.

Determination of whether the image data is empty can be made by summing or averaging the values of all pixels or a selected sample of pixels in the image data and comparing the result to a threshold, or by other ways known in the image-processing art. In various embodiments, image data is a rectangular matrix of pixel values, each 0%-100%. 0% means that no toner should be deposited at that pixel site on receiver 42, and 100% means that the maximum possible amount of toner should be deposited at that pixel site. Empty image data can include some pixels with values greater than 0%. For example, image data representing a scan of a photocopied white page can include some pixels with values representing the background development of the photocopier used to make the copied page. These values can call for visible amounts of toner to be deposited on the receiver. Notwithstanding, this image data can still be regarded as empty. In another example, an empty page with a single 100% pixel in the center can still be regarded as empty.

When the image data is not empty, in step 1030, developer is automatically supplied to the development members in printer 100. Step 1030 is followed by decision step 1040.

Decision step 1040 decides whether the any development member is in a non-development zone, as discussed above with reference to FIG. 7. If not, the next step is step 1030. If so, the next step is step 1045.

In step 1045, the developer is automatically removed from the respective non-developing zone of each development member while the development member rotates, whereby background development is reduced in the non-image area of each separation. After step 1045, control returns to step 1030, and the loop of 1020, 1040, 1045 repeats until all the separations have finished printing.

Background development is transfer of toner from photoreceptor 206 (FIG. 4) into non-image area 540 (FIG. 5). Step 1045 results in a reduction of this background development. Very little developer (or even no developer) reaches toning zone 640 (FIGS. 6A-6B) when developer remover 610 (FIGS. 6A-6B) is in non-developing zone 710 (FIG. 7). Therefore, very little developer is present in toning zone 640 when a position on photoreceptor 206 corresponding to non-image area 540 on receiver 42 (FIG. 5) is in toning zone 640. Consequently, very little developer can transfer from development member 403 (FIG. 4) to photoreceptor 206 to be applied to non-image area 540. Therefore, very little toner can contribute to background development. Background development is thus reduced compared to prior-art systems in which, when a position on photoreceptor 206 corresponding to non-image area 540 is in toning zone 640, a full nap of developer is also present in toning zone 640.

As discussed above with reference to decision step 1020, in various embodiments, if the image data for a separation is empty, steps 1083 or 1086 are used. In step 1083, developer is automatically removed from the entire width of the respective image area, wherein the respective image area is a page window. This advantageously reduces background development e.g. in separations with no data by preventing developer from reaching the photoreceptor for that separation. This can be employed in CMYK systems when printing jobs without undercomponent removal (UCR), so that only the CMY channels are used. The developer can be removed from the K separation's development member to greatly reduce background development of black toner. Some toner can still develop due to artifacts, but the amount will be greatly reduced, as discussed above. Similarly, in a five-component CMYK+Clear system, when printing a CMYK-only job, the developer that includes clear toner can be removed from the entire width of the corresponding development member to reduce background development of clear toner. "Entire width" means that portion of the development member from which toner can be transferred to the receiver. If the development member protrudes beyond the receiver in the cross-track direction, developer can be removed from the protruding area or not, yet still be removed from the entire width of the image area.

In various embodiments, a respective developer supply is provided in each development station for providing developer to the respective development member. The developer supply includes a mixer selectively operable to mix the developer, as discussed above. Specifically, the respective mixer is operated in each development station of a separation for which the respective image data is determined not to be empty. In step

1086, for separations for which the respective image data is determined to be empty, the respective mixer in the development station is stopped, i.e. not operated.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
102, 103 roller
104 transmission densitometer
105 power supply
109 interframe area
110 light beam
111, 121, 131, 141, 151 imaging member
112, 122, 132, 142, 152 transfer member
113, 123, 133, 143, 153 transfer backup member
124, 125 corona tack-down chargers
201 transfer nip
202 second transfer nip
206 photoreceptor
210 charging subsystem

PARTS LIST—CONTINUED

211 meter
212 meter
213 grid
216 surface
220 exposure subsystem
225 development subsystem
226 toning shell
227 magnetic core
240 power source
400 development station
401 blender
402 roller
403 development member
404, 414 backup bar
405 encoder
406 controller
407 image loop
420 developer supply
500 job
510, 511, 512 separation
520 boundary data
530 image area
540 non-image area
550 image data
555 visible image
610 developer remover
611 retractable blade
612 hub
620 metering skive

PARTS LIST-CONTINUED

640 toning zone
691 developer remover position
692 developer remover position
695 developer remover position
696 developer remover position
710 non-developing zone
720 developing zone
810 width
820 page window
903 width
910 developer remover
926, 929 span
1005 receive job step
1010 provide development stations step
1012 provide developer remover step
1015 calculate zones step
1020 decision step
1030 supply developer step
1040 decision step
1045 remove developer step
1083 remove all developer step
1086 stop mixer step
$R_n$-$R_{(n-6)}$ receiver

The invention claimed is:

1. A printer for printing a job onto a receiver, the job including boundary data defining an image area of a separation and a non-image area of the separation, and image data defining a visible image to be produced in the image area, the printer comprising:

a) a rotatable photoreceptor for transferring the visible image comprising toner and corresponding to the image data onto the image area of the moving receiver;

b) a rotatable development member arranged with respect to the photoreceptor to provide toner to the photoreceptor;

c) a developer supply arranged with respect to the development member to provide developer to the development member, wherein the developer includes toner;

d) a developer remover disposed adjacent to the rotatable development member between the developer supply and the photoreceptor in the direction of rotation of the development member, the developer remover operative to selectively make physical contact with at least one point on the development member to remove developer from the development member; and e) a controller responsive to the boundary data and adapted to perform the following functions while printing the job onto the receiver:

i) calculate a non-developing zone of the development member corresponding to the non-image area, and a developing zone of the development member corresponding to the image area; and ii) cause the developer remover to contact the development member when the developer remover is in the non-developing zone, and for causing the developer remover to not contact the development member when the developer remover is in the developing zone.

2. The apparatus according to claim 1, wherein the image area is a page window and the developer remover extends across the full width of the image area.

3. The apparatus according to claim 1, further including a second developer remover operative to selectively make physical contact with at least one point on the development member to remove developer from the development member; wherein the developer remover and the second developer remover extend across respective spans of the width of the development member less than the width of the development member, so that the respective spans do not overlap or touch along the width of the development member; and the controller causes the second developer remover to contact the development member when the second developer remover is in the non-developing zone, and causes the second developer remover to not contact the development member when the second developer remover is in the developing zone.

4. The apparatus according to claim 3, further including a metering skive disposed adjacent to the rotatable development member between the developer remover and the photoreceptor in the direction of rotation of the development member, for permitting at most a selected amount of developer to pass the metering skive.

* * * * *